US005839611A

United States Patent [19]

Obadia et al.

[11] Patent Number: 5,839,611

[45] Date of Patent: Nov. 24, 1998

[54] DISPENSER FOR REMOVING A FLUID FROM A CONTAINER

[75] Inventors: Jacques Obadia, Paris; Bernard Guglielmini, Crimolois, both of France

[73] Assignee: Rical S.A., Longvic, France

[21] Appl. No.: 894,919

[22] PCT Filed: Apr. 1, 1996

[86] PCT No.: PCT/FR96/00486

§ 371 Date: Sep. 24, 1997

§ 102(e) Date: Sep. 24, 1997

[87] PCT Pub. No.: WO96/30273

PCT Pub. Date: Oct. 3, 1996

[30] Foreign Application Priority Data

Mar. 31, 1995 [FR] France ..... 95 03840

[51] Int. Cl.[6] ..... B67D 5/33

[52] U.S. Cl. ..... 222/153.14; 222/520

[58] Field of Search ..... 222/153.07, 153.14, 222/153.09, 520

[56] References Cited

U.S. PATENT DOCUMENTS

| | | | |
|---|---|---|---|
| 2,913,152 | 11/1959 | Vidaver . | |
| 3,348,848 | 10/1967 | Lucking et al. . | |
| 3,759,429 | 9/1973 | Ardito et al. . | |
| 5,141,129 | 8/1992 | Jennings | 222/153.14 |
| 5,303,850 | 4/1994 | Connan | 222/153.14 |
| 5,657,906 | 8/1997 | Rapchak et al. | 222/153.14 |
| 5,749,496 | 5/1998 | DeJonge, Sr. et al. | 222/153.14 |

FOREIGN PATENT DOCUMENTS

| | | |
|---|---|---|
| 760941 | 5/1971 | Belgium . |
| A-760941 | 5/1971 | Belgium . |
| 2584681 | 1/1987 | France . |
| 90 130 39.1 | 1/1991 | Germany . |
| 288361 | 5/1953 | Switzerland . |
| WO 80/02546 | 11/1980 | WIPO . |

*Primary Examiner*—Philippe Derakshani
*Attorney, Agent, or Firm*—Beveridge, DeGrandi, Weilacher & Young, LLP

[57] ABSTRACT

A dispenser for removing a fluid from a container, including a fixed part with a portion for attachment to the container and a generally cylindrical pouring portion, a side fluid outlet, a moveable part and a head portion. A tamper-proof strip defines a first axial position and snap means define a second axial position for the moveable part relative to the fixed part.

10 Claims, 7 Drawing Sheets

DISPENSER FOR REMOVING A FLUID FROM A CONTAINER

BACKGROUND OF INVENTION

The present invention relates to a dispenser for drawing off a fluid product held in a container.

Such a dispenser is known from the document WO 80/02 546. This dispenser or tab, intended more particularly for containers of the "bag-in-box" type (combining a flexible internal container in the form of a bag or bladder and a rigid external container), comprises a fixed piece forming the tap body, comprising a part for attachment to the container which is extended toward the outside of the container by a pouring part of cylindrical general shape, open at its two axial ends and pierced by a lateral fluid outlet orifice. This dispenser furthermore comprises a movable piece which comprises a closure part of cylindrical general formula [sic] fitted tightly in the pouring part of the fixed piece open at its internal axial end, closed at its external axial end and pierced by a lateral fluid outlet orifice, and a top part enabling the movable piece to be gripped and operated from the outside. Moreover, the two pieces comprise means designed to define a first axial position of the movable piece with respect to the fixed piece, in which position the lateral orifices of the two pieces are axially offset so as not to be able to be brought into coincidence, and therefore into communication, whatever the angular position of the movable piece with respect to the fixed piece, and means designed to define a second axial position of the movable piece with respect to the fixed piece, in which position the lateral orifices of the two pieces can be brought into coincidence and therefore into communication, by rotating the movable piece with respect to the fixed piece.

A first drawback of this known dispenser, in which the said first axial position is that in which the movable piece has been extracted from the fixed piece and the said second axial position is that in which the movable piece has been pushed into the fixed piece, consists in the fact that nothing is provided to keep the movable piece with certainty in the first axial position until the movable piece has been intentionally operated for the purpose of dispensing fluid for the first time. Accidental or inadvertent dispensing of fluid cannot therefore be excluded with certainty. Moreover, given the structure of this known dispenser, operating the head part of the movable piece, by rotation, for the purpose of dispensing fluid, is not easy since the head part, in the second axial position, is difficult to access for the purpose of rotating it. In addition, no provision is made, and it is not possible, in this known dispenser, to bring the movable piece back from the second axial position to the first axial position, i.e. to the position in which rotating the movable piece does not result in fluid being dispensed. Finally, this known dispenser does not have so-called tamperproofing means giving the user a guarantee that the container, and it contents, is in perfect condition when it is purchased.

SUMMARY OF INVENTION

The object of the present invention is to provide a dispenser for drawing off a fluid product held in a container, which dispenser remedies the drawbacks described above of the known dispensers.

The dispenser, which is the subject of the invention, for drawing off a fluid product held in a container includes a fixed piece comprising a part for attachment to the container, which part is extended toward the outside of the container by a pouring part of cylindrical general shape, open at its two axial ends and pierced by a lateral fluid outlet orifice. This dispenser furthermore includes a movable piece comprising a closure part of cylindrical general shape fitted tightly in the pouring part of the fixed piece open at its internal axial end, closed at its external axial end and pierced by a lateral fluid outlet orifice, and a top part enabling the movable piece to be gripped and operated from the outside. The movable piece is mounted so as to be able to move in axial translation and in rotation in the fixed piece. The fixed piece and the movable piece include means designed to define a first axial position of the movable piece with respect to the fixed piece, in which position the lateral orifices of the two pieces are axially offset so as not to be able to be brought into coincidence, whatever the angular position of the movable piece with respect to the fixed piece, and means for defining a second axial position of the movable piece with respect to the fixed piece, in which position the lateral orifices of the two pieces can be brought into coincidence by rotating the movable piece. In the dispenser according to the invention, the said first axial position of the movable piece is the position in which the movable piece has been pushed fully into the fixed piece and the said second axial position is the position in which the movable piece has been extracted from the fixed piece. The first axial position of the movable piece is defined by a tamperproofing strip which, until it has been torn off, connects the top part of the movable piece to the fixed piece. The second axial position of the movable piece is defined by snap-fastening means designed to allow rotation of the movable piece in this second [lacuna] position.

Preferably, the tamperproofing strip connects the top part of the movable piece to a catching ring snap-fastened onto the fixed piece.

Thus, the movable piece (the closure part and the top part) may be made as a single piece by molding with the tamperproofing strip and with the catching ring, and this combination may be assembled with the separately molded fixed piece, the closure part of the movable piece being fitted right to the bottom into the pouring part of the fixed piece, the two pieces being fastened to each other by snap-fastening of the catching ring of the movable piece behind an external bead formed on the fixed piece.

Advantageously, the top part of the movable piece has an external rim for gripping and the tamperproofing strip connects the said external rim to the fixed piece, preferably to the catching ring which engages by snap-fastening with the fixed piece.

Preferably, the external rim of the top part, the tamperproofing strip and, optionally, the catching ring of the movable piece and the attachment part of the fixed piece have approximately the same external diameter, giving the entire dispenser, before opening it for the first time, a cylindrical general external shape, i.e. an approximately smooth external shape, without any projecting parts.

The lateral orifice provided on the pouring part of the fixed piece may advantageously include a pouring spout, this being preferably roughly radial, thereby allowing uniform pouring whatever the flow rate controlled by the lateral orifices of the two pieces of the dispenser overlapping to a greater or lesser extent.

The snap-fastening means defining the second axial position of the movable piece with respect to the fixed piece may advantageously include an internal bead on the fixed piece and an external bead on the closure part of the movable piece.

The internal bead is advantageously formed on a skirt which extends the pouring part of the fixed piece toward the inside of the container.

Preferably, the cylindrical closure part of the movable piece has at least one cutout extending from the internal end of the closure part over an axial depth such that the said cutout is axially offset with respect to the lateral orifice of the fixed piece in the first axial position of the movable piece and can, in the second axial position of the latter, be brought into coincidence with the lateral orifice of the fixed piece by rotating the movable piece.

According to a preferred embodiment, two diametrically opposed cutouts are provided in the closure part of the movable piece.

This makes it possible, in the second axial position of the movable piece, to bring one or other of these two cutouts into coincidence with the lateral orifice of the fixed piece, by a rotational movement of less than 180° in one direction or the other. In addition, these two cutouts give the closure part, at the point of its snap-fastening bead, a flexibility conducive to its snap-fastening in the second axial position.

If the dispenser is intended to equip a container holding a liquid, it may be advantageous to provide, in the pouring part of the fixed piece, in a position diametrically opposite the lateral orifice in this part, one or more aeration holes which allow, as the liquid progressively flows out of the container, a corresponding volume of air to enter into the container, thus avoiding the formation, inside the container, of a partial vacuum which could disrupt the uniform flow of the liquid.

A more detailed description of an illustrative and non-limiting embodiment of a dispenser according to the invention will be given below, with reference to the appended diagrammatic drawings; in these drawings:

SUMMARY

Figure 1:
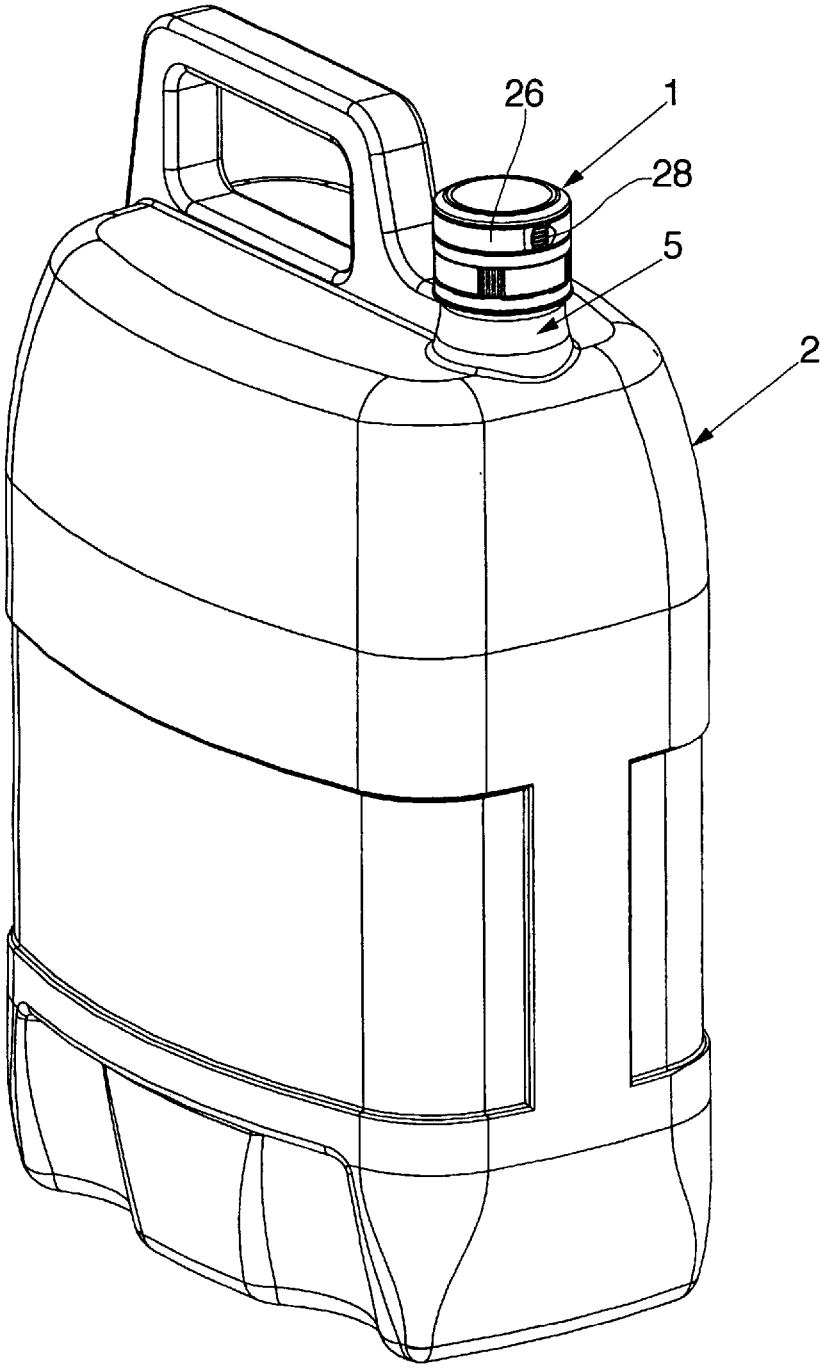
FIG. 1 is a perspective view of a can equipped with a dispenser according to the invention.

As illustrated by the drawings, the dispenser 1 according to the invention for drawing off a fluid, for example a liquid, from a container 2, shown in FIG. 1 in the form of a plastic can, is composed of two components 3 and 4, namely a component 3 intended to be attached to the neck 5 of the container 2 and a component 4 which engages with the component 3 in order to actuate and control the drawing-off of the fluid held in the container 2.

The component 3 includes a part 6 for attachment to the neck 5, this part being composed of an external skirt 7 provided with an internal thread 8 and of an internal skirt 9 which engages with the internal surface of the neck 5 in order to provide a seal between the component 3 and the neck 5. The external skirt 7 has, some distance above the thread 8, a step toward the inside, forming an annular shoulder 10. Above the shoulder 10, the external skirt 7 has an external annular bead 11 and then joins the internal skirt 9 by means of an internal annular rim 12 which extends radially inward beyond the internal skirt 9.

The attachment part 6 is extended, at the internal edge of the rim 12, axially upward in the Figures, i.e. toward the outside of the container 2, by a pouring part 13 of cylindrical general shape. The pouring part 13 has, laterally, some distance above the rim 12, a liquid flow orifice 14 lying roughly halfway along the part 13. The orifice 14 is surrounded by a pouring spout 15 which extends radially outward. In a position diametrically opposite the orifice 14, the pouring part 13 has an air inlet orifice 16 lying, along the axis of the pouring part 13, roughly level with the lower edge of the orifice 14.

A short cylindrical skirt 17, having at its lower end a circular row of internal beads 18, extends downward from the rim 12 in such a way that the internal ends of the beads 18 lie approximately on the downward extension of the internal surface of the pouring part 13.

Finally, a tamperproofing ring 19, having an internal catching bead 20 (or several internal catching lugs) is connected by frangible bridges 20*a* to the lower edge of the external skirt 7 of the component 3.

The component 4 includes a closure part 21 which has the shape of a cylindrical skirt projecting from a top 22 which closes off the skirt 21 at its upper end. The top 22 is extended radially outward beyond the skirt 21, in the shape of an annular external rim 23. The skirt 21 has two diametrically opposed cutouts 24 which extend, from the lower end of the skirt, upward approximately as far as halfway up the latter. Moreover, the skirt 21 has, at its lower edge, an external bead 25 which extends around the entire perimeter of the skirt 21, apart from the point where the cutouts 24 are.

A tearable tamperproofing strip 26, made as a single piece with the rim 23 of the top 22, is connected to the said rim by an annular region 27 of lower strength. The tamperproofing strip 26 has, as shown in FIGS. 1 to 4, a gripping tab 28 enabling one end of the strip 26 to be gripped in order to tear it off. At its lower end, the cylindrical tamperproofing strip 26 is connected by an annular region 29 of lower strength to a catching ring 30 provided on the inside with an annular bead 31 intended to engage by snap-fastening with the external bead 11 of the attachment part 6 of the component 3.

The component 3 is made as a single piece with the tamperproofing ring 19, by molding in a plastic. The component 4 is made as a single piece with the tamperproofing strip 26 and the catching ring 30, also by molding in a thermoplastic.

Before fitting the dispenser 1, formed by the two components 3 and 4, onto the neck 5 of the container 2, the two components 3 and 4 are assembled, by inserting the skirt 21 of the component 4 into the pouring part 13 of the component 3 until, after the external bead 25 of the element 4 has gone beyond the internal bead 18 of the component 3, the catching ring 31 of the component 4 is snap-fastened under the bead 10 of the component 3, by bearing on the shoulder 10. In this position, which is visible in FIGS. 2 and 3, the upper edge of the cutouts 24 of the skirt 21 of the component 4 is lower than the lower edge of the orifice 14 of the pouring part 13 of the component 3

Figure 3:
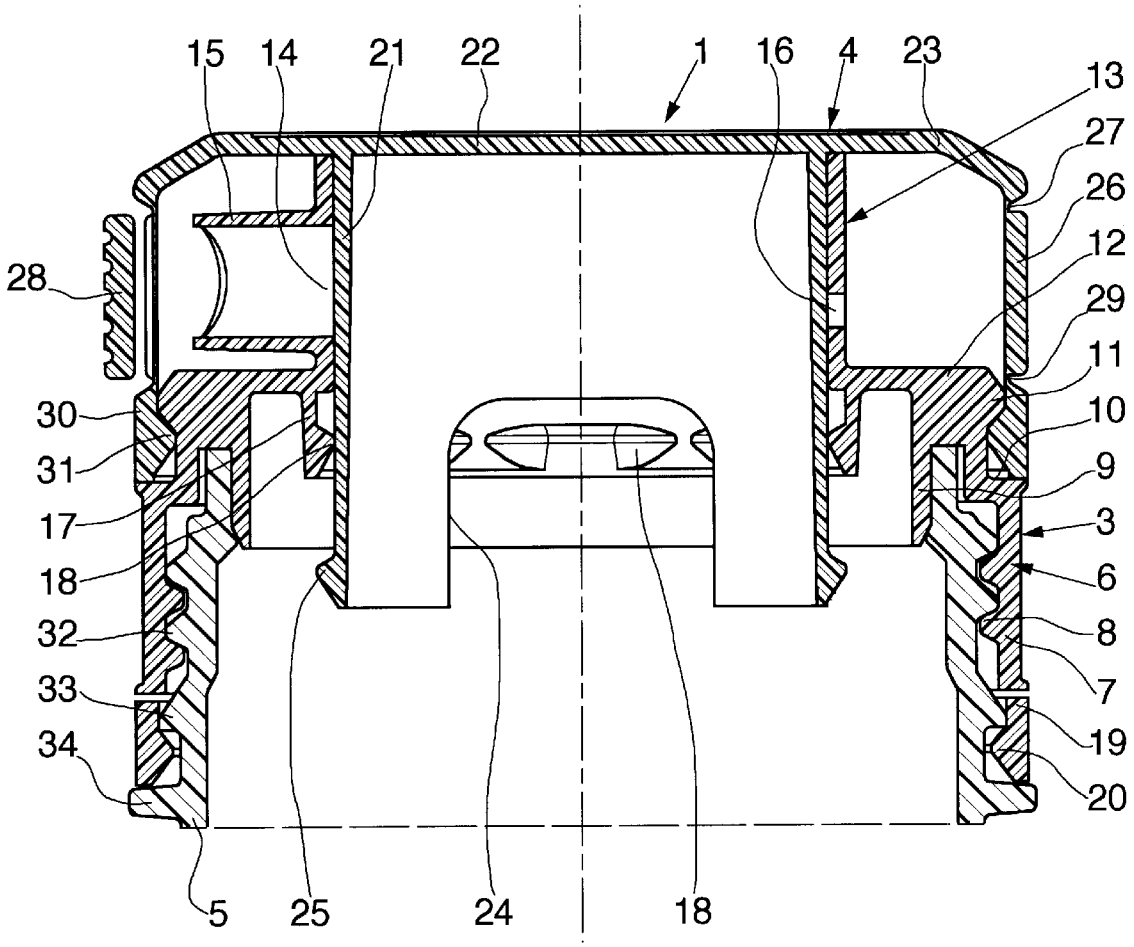
FIG. 3 is a section on III—III in FIG. 2.
Figure 4:
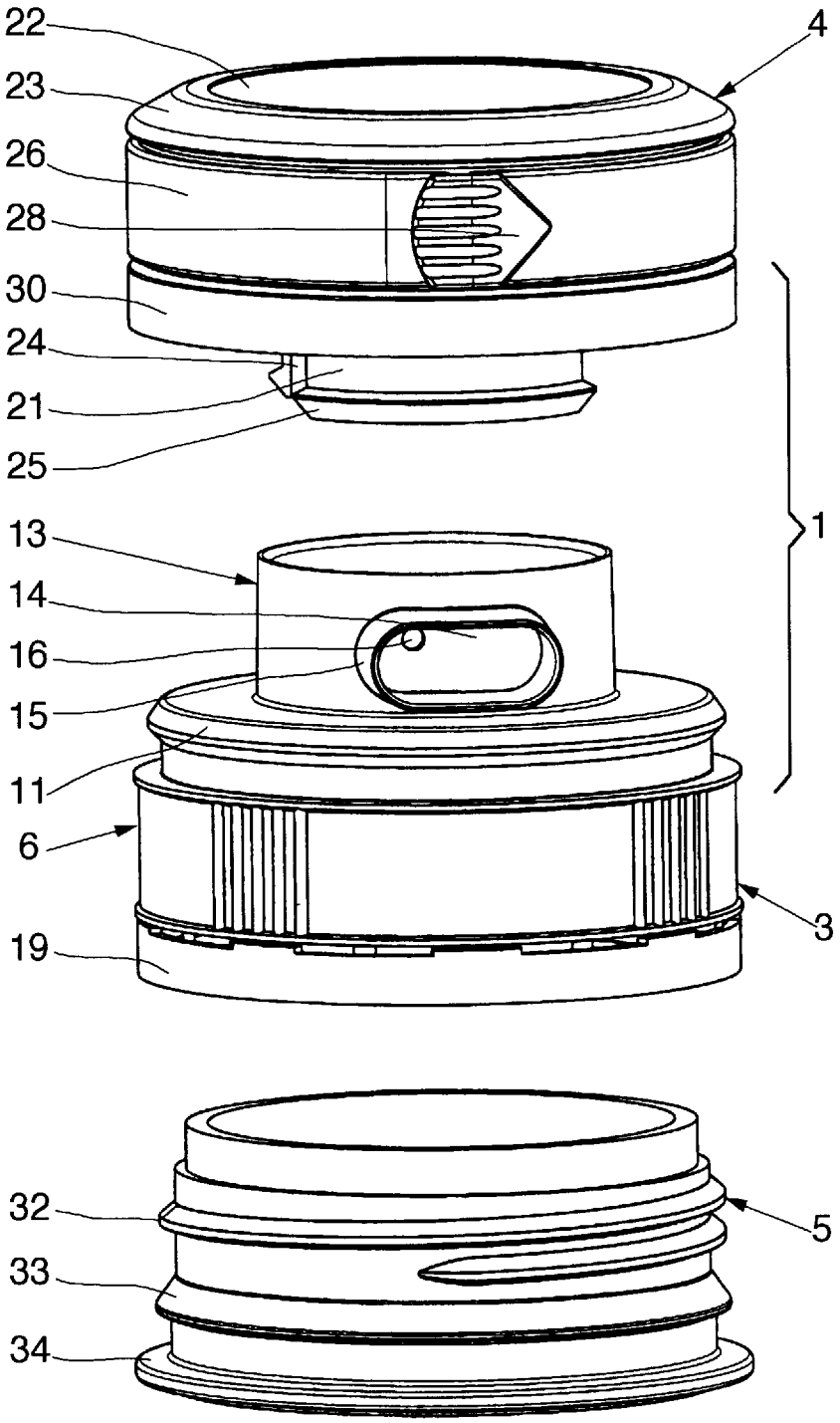
FIG. 4 is an exploded perspective view of the dispenser in FIG. 2, showing its two constituent components and the neck of the can.
Figure 5:
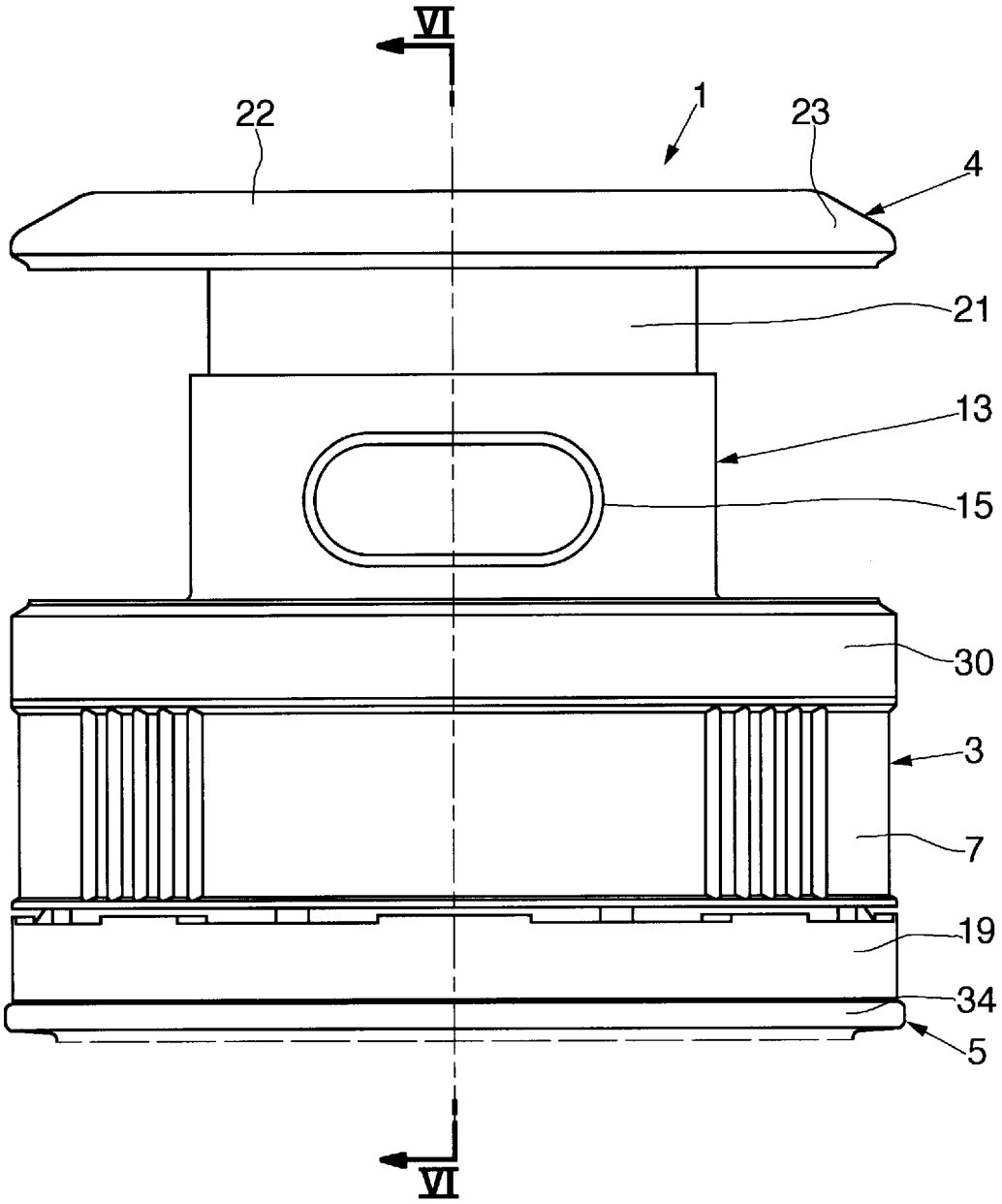
FIG. 5 is a view similar to that in FIG. 2, after the tamperproofing strip has been torn off and the movable part has been pulled up.
Figure 6:
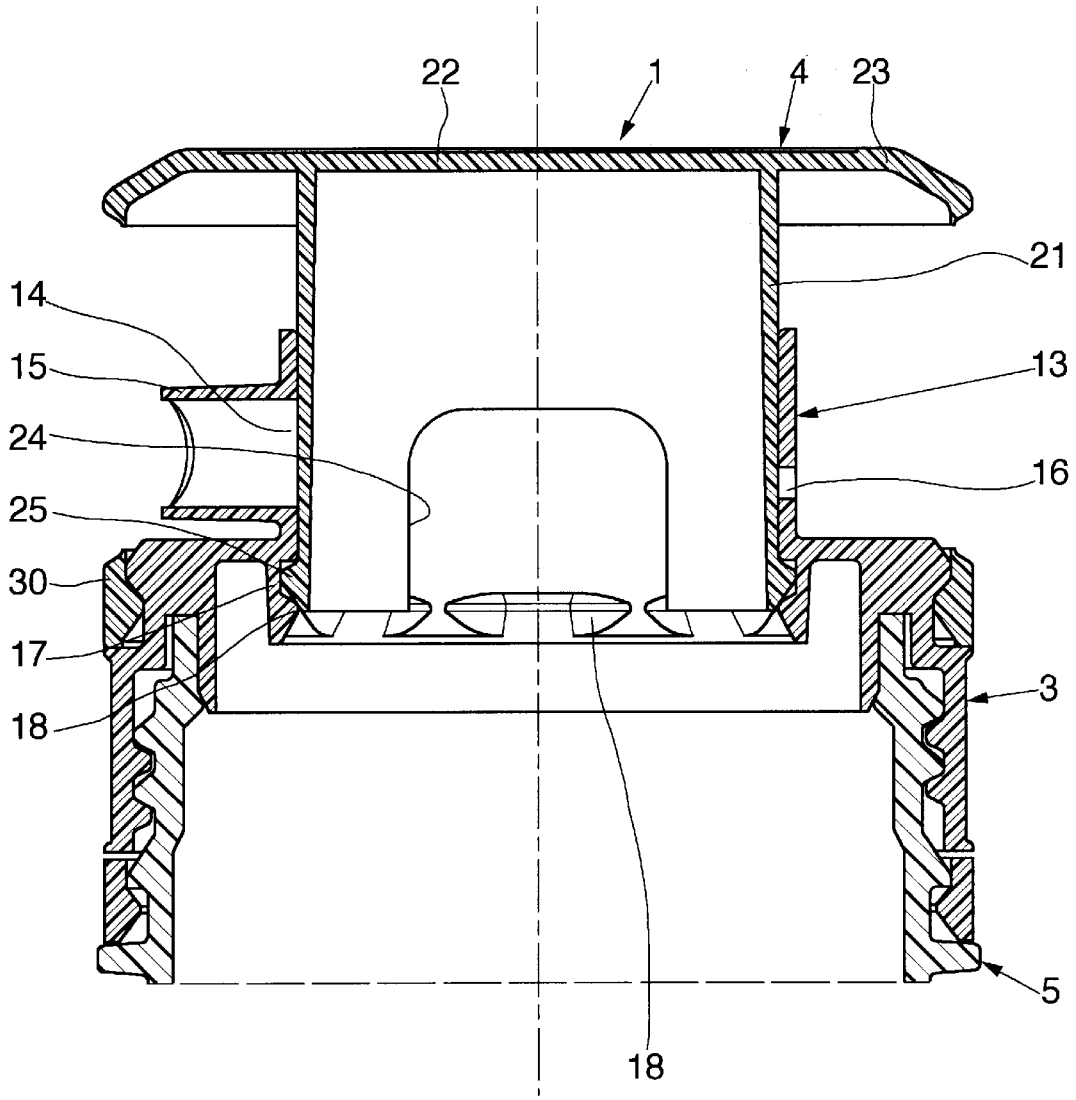
FIG. 6 is a section on VI—VI in FIG. 5.

Preferably, the two components 3 and 4 may be assembled in this way with well-defined angular positioning of the component 4 with respect to the component 3, namely in such a way that the tear off tab 28 of the tamperproofing strip 26 lies in line with the pouring spout 15 of the orifice 14 (see FIG. 3).

In order to fit the dispenser 1 thus assembled from the components 3 and 4 onto the container 2, the neck 5 of which has an external thread 32 and, under the latter, an external catching bead 33 and an external bearing rim 34, the dispenser 1 is screwed onto the neck 5. The height of the rim 12 of the component 3, at the point where this rim 12 bears on the upper edge of the neck 5, is advantageously chosen in such a way that when the dispenser 1 is screwed right onto the neck 5, the internal bead 20 of the tamperproofing ring 19 being snap-fastened under the external bead 33 of the neck 5, the dispenser 1 occupies a well-defined angular position with respect to the neck 5.

In the embodiment shown, the pouring spout 15, which lies under the tear-off tab 28 of the tamperproofing strip 26, thus occupies an angular position such that, when the can 2 is lying on its side, such that the dispenser 1 is placed lower down, the pouring spout 15 is oriented downward.

In order to provide a seal between the two components 3 and 4, it is necessary for the external diameter of the skirt 17 of the component 4 and the internal diameter of the pouring part 13 of the component 3 to be matched so that the skirt 21 of the component 4 fits tightly in the pouring part 13 of the component 3.

Figure 2:
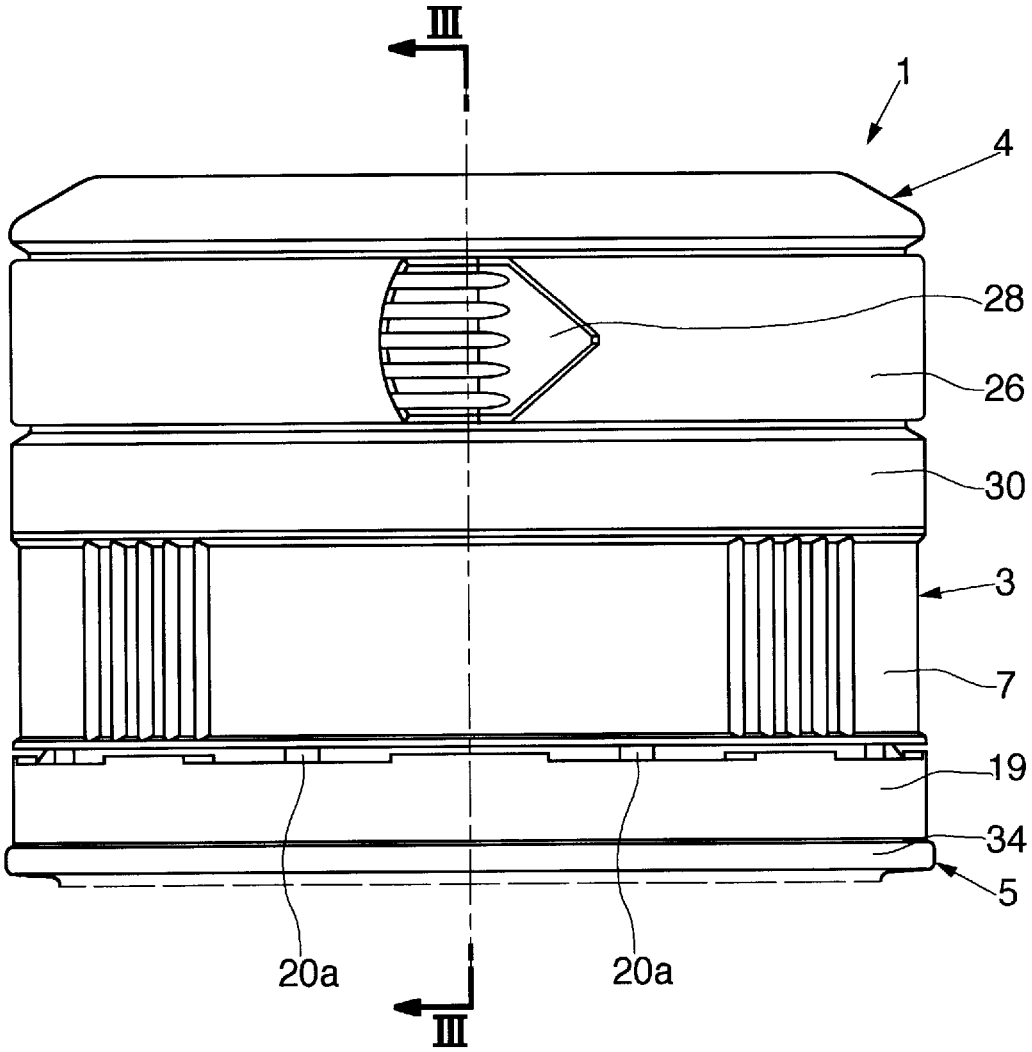
FIG. 2 is a front elevation view of the dispenser, before the tamperproofing strip has been torn off.

Until the tamperproofing strip 26 has been torn off, the component 4 occupies the position according to FIGS. 1 to 3 and any drawing-off, whether intentional or not, is impossible.

Figure 7:
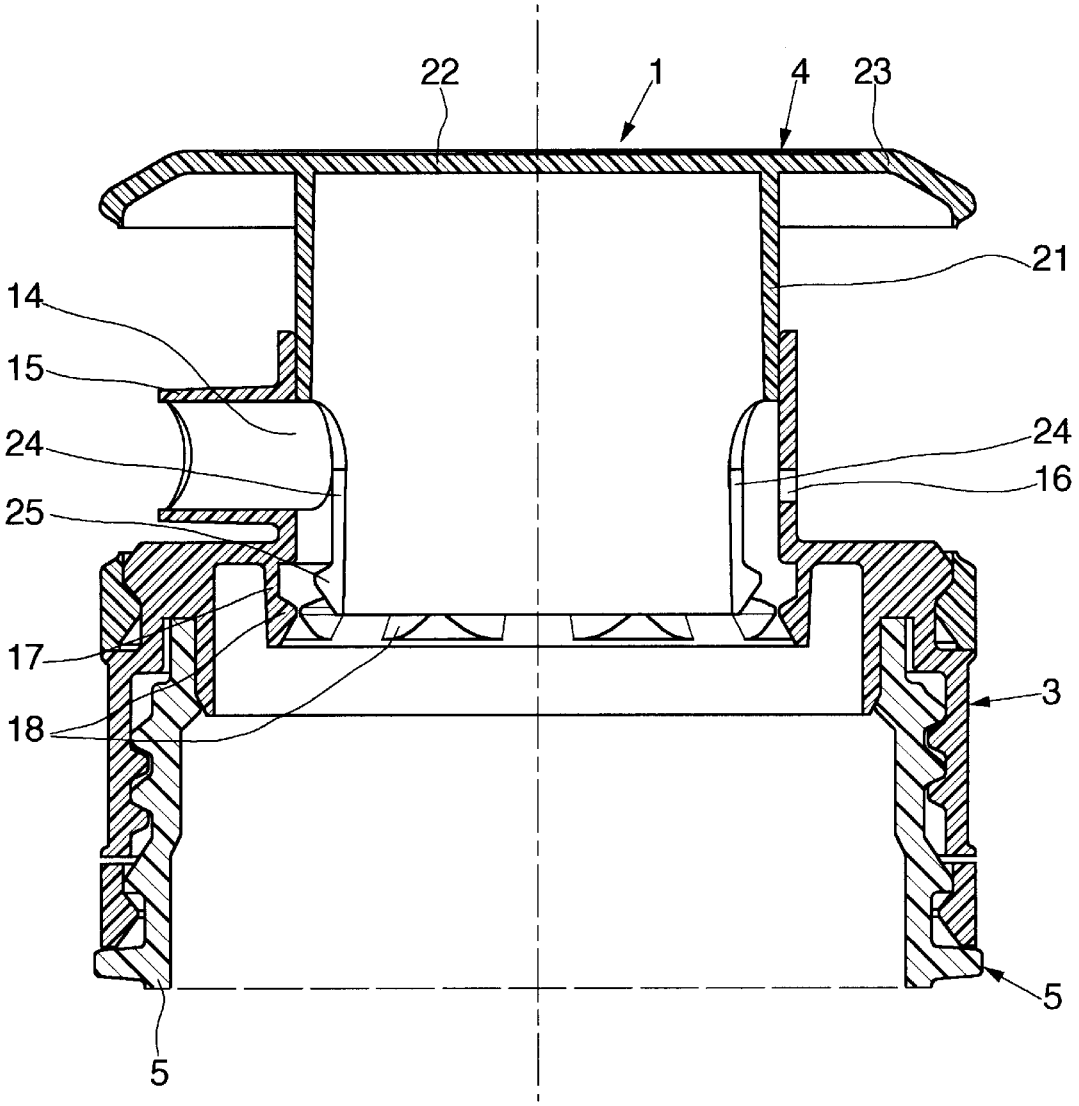
FIG. 7 is a section similar to that in FIG. 6, after the movable piece has been rotated so that the outlet orifices of the movable piece and of the fixed piece come into coincidence.

Upon opening for the first time, the tamperproofing strip 26 is torn off and the top 22 of the element 4 is pulled in order to extract the latter until the external bead 25 of the component 4 is snap-fastened behind the internal bead 18 of the component 3. In this position, neither of the two cutouts 24 is in coincidence with the orifice 14. It is only by a rotational movement printed on the component 4, in one direction or the other, that it is possible to bring one or other of the two cutouts 24 opposite the orifice 14, thereby allowing draw-off with a flow rate which is controlled by the degree of overlap of this cutout 24 with the orifice 14. At the same time, the opposite cutout 24 comes into coincidence with the orifice 16, thus allowing air to enter the container progressively as the fluid held in the container flows out via the orifice 14 and the pouring spout 15 (see FIG. 7).

When the required quantity of fluid has been drawn off, the user can stop drawing-off by rotating the component 4 so that the cutout 24 no longer coincides with the orifice 14 and pouring is interrupted. In order to make the container safer from inadvertent pouring, the user may moreover push on the component 4 in order to bring it back into the pushed-in position as in FIG. 3, in which position, even by rotating the component 4, it is not possible to bring the cutouts 24 into coincidence with the orifice 14 because of the axial offset of the cutouts with respect to the orifice.

It goes without saying that the embodiment shown and described has been given merely by way of illustrative and non-limiting example and many modifications and variants are possible within the scope of the invention.

Thus, the dispenser 1, instead of being attached by screwing, could also be attached by snap-fastening onto an appropriately shaped neck. In this case, in order to ensure that the dispenser has been put into a correct angular position with respect to the container, it is possible to provide, both on the attachment part 6 of the component 3 and on the neck 5 of the container, angular positioning means which engage with each other so as to allow snap-fastening of the dispenser onto the neck only in the desired angular position.

The snap-fastening defining the position in which the movable component 4 has been extracted could be achieved by means other than the beads 18 and 25. The tamperproofing strip 26 could engage directly with the component 3, which would dispense with the catching ring 30.

The dispenser according to the invention may be used for 1 [sic] drawing off any fluid product able to be dispensed by pouring from a container. In the case of liquids, the venting orifice 16 may advantageously be provided so as to prevent the creation of a partial vacuum in the container, which could cause disruption to uniform draw-off. The dispenser according to the invention may also be used, for example, for drawing off powders or other fluid solid products, for example those in the form of ballotini. In this case, a venting orifice may prove to be superfluous.

Moreover, the dispenser according to the invention could also have an external general shape other than the cylindrical shape shown.

We claim:

1. Dispenser for drawing off a fluid product held in a container (2) which includes a fixed piece (3) comprising a part (6) for attachment to the container, which part is extended toward the outside of the container by a pouring part (13) of cylindrical general shape, open at its two axial ends and pierced by a lateral fluid outlet orifice (14), a movable piece (4) comprising a closure part (21) of cylindrical general shape fitted tightly in the pouring part (13) of the fixed piece (3) open at its internal axial end, closed at its external axial end and pierced by a lateral fluid outlet orifice (24), and a top part (22, 23) enabling the movable piece (4) to be gripped and operated from the outside, the movable piece (4) being mounted so as to be able to move in axial translation and in rotation in the fixed piece (3), the fixed piece (3) and the movable piece (4) including means (11, 26, 29, 30, 31) designed to define a first axial position of the movable piece with respect to the fixed piece, in which position the lateral orifices (14, 24) of the two pieces are axially offset so as not to be able to be brought into coincidence, and means (18, 25) for defining a second axial position of the movable piece with respect to the fixed piece, in which position the lateral orifices (14, 24) of the two pieces can be brought into coincidence by rotating the movable piece, characterized in that the said first axial position of the movable piece (4) is the position in which the movable piece (4) has been pushed fully into the fixed piece (3) and the said second axial position is the position in which the movable piece (4) has been extracted from the fixed piece (3), in that the first axial position of the movable piece (4) is defined by a tamperproofing strip (26) which, until it has been torn off, connects the top part (22, 23) of the movable piece (4) to the fixed piece (3) and in that the second axial position of the movable piece is defined by snap-fastening means (18, 25) designed to allow rotation of the movable piece (4) in this second axial position.

2. Dispenser according to claim 1, characterized in that the tamperproofing strip (26) connects the top part (22, 23) of the movable piece (4) to a catching ring (30) snap-fastened onto the fixed piece (3).

3. Dispenser according to claim 1, characterized in that the top part (22, 23) of the movable piece (4) has an external rim (23) and in that the tamperproofing strip (26) connects the said external edge (23) to the fixed piece (3), preferably to the catching ring (30) snap-fastened onto the fixed piece (3).

4. Dispenser according to claim 3, characterized in that the external rim (23) of the top part, the tamperproofing strip (26), where appropriate the catching ring (30) of the movable piece (4) and the attachment part (6) of the fixed piece (3) have approximately the same external diameter.

5. Dispenser according to claim 3, characterized in that the lateral fluid outlet orifice (14) of the fixed piece (3) has an external pouring spout.

6. Dispenser according to claim 1, characterized in that the snap-fastening means defining the second axial position of the movable piece with respect to the fixed piece include an internal bead (18) on the fixed piece (3) and an external bead (25) on the closure part (21) of the movable piece (4).

7. Dispenser according to claim 6, characterized in that the internal bead (18) is formed on a skirt (17) which extends the pouring part (13) of the fixed piece (3) toward the inside of the container.

8. Dispenser according to claim 1, characterized in that the cylindrical closure part (21) of the movable piece (4) has at least one cutout (24) extending from the internal end of the closure part over an axial depth such that the said orifice (14) of the fixed piece (3) in the first axial position of the movable piece (4) and can, in the second axial position of the latter, be brought into coincidence with the lateral orifice (14) of the fixed piece (3) by rotating the movable piece (4).

9. Dispenser according to claim 6, characterized in that two diametrically opposed cutouts (24) are provided in the cylindrical closure part (21) of the movable piece (4).

10. Dispenser according to claim 1, characterized in that the fixed piece (3) is attached by screws to the neck (5) of the container (2) and in that the fixed piece (3) has, on its attachment part (6), a tamperproofing ring (19) which engages by snap-fastening with the neck (5).

* * * * *